United States Patent [19]

Schiller

[11] 4,344,240

[45] Aug. 17, 1982

[54] IDENTIFICATION SNAP

[75] Inventor: Karl H. Schiller, Dayton, Ohio

[73] Assignee: S and S Associates, Dayton, Ohio

[21] Appl. No.: 225,486

[22] Filed: Jan. 16, 1981

[51] Int. Cl.[3] ..... G09F 3/08; A44B 1/18; A44B 1/38

[52] U.S. Cl. ..... 40/20 R; 24/90 A; 24/108; 40/301

[58] Field of Search ..... 40/20 A, 20 R, 2 A, 40/301, 25 R, 21 R, 21 A, 21 B, 21 C, 22, 23 R, 23 A, 24, 25 A, 26; 24/90 A, 108, 204, 208 A; D20/22, 27

[56] References Cited

U.S. PATENT DOCUMENTS

| | | | |
|---|---|---|---|
| 506,110 | 10/1893 | Hampel | 24/108 |
| 1,053,960 | 2/1913 | Furstenau . | |
| 2,289,228 | 7/1942 | Warner | 40/20 R |
| 2,397,801 | 4/1946 | Mitchell | 24/204 |
| 2,709,290 | 5/1955 | Rosenthal | 24/204 |
| 2,775,093 | 12/1956 | Kundert | 59/80 |
| 2,860,395 | 11/1958 | Anderson | 24/90 A |
| 3,439,439 | 4/1969 | Stimson | 24/90 A |
| 3,532,212 | 10/1970 | Gatton et al. | 206/56 |
| 3,678,608 | 7/1972 | Minasy | 40/20 R |
| 3,691,597 | 9/1972 | Kahn | 24/108 |
| 3,729,780 | 5/1973 | White | 24/156 |
| 4,044,412 | 8/1977 | Barron | 5/356 |

*Primary Examiner*—Robert Peshock
*Assistant Examiner*—Michael J. Foycik
*Attorney, Agent, or Firm*—Biebel, French & Nauman

[57] ABSTRACT

An identification snap for attachment to woven material such as clothing includes a first plate member bearing identifying indicia on an outer surface and a post projecting from an inner surface, and a second plate member including a centrally disposed orifice extending from an inner face to an outer face, the orifice being defined by a substantially frusto-conical wall which converges toward the inner face. The orifice is sized to receive the post of the first plate member in an interference fit so that when the first plate member is placed against the fabric of a garment with the post extending through it and the second plate member is placed on the opposite side of the fabric, the post can be received within the orifice, thereby joining the first and second plate members and clamping the fabric therebetween. The post preferably has a bulbous tip which prevents fabric damage and also cooperates with the frusto-conically shaped orifice to provide the interference fit so that the tip can be received and held in the orifice at varying distances to accommodate woven materials of varying thicknesses.

9 Claims, 10 Drawing Figures

IDENTIFICATION SNAP

BACKGROUND OF THE INVENTION

1. Field of the Invention

The present invention relates to identification tags used in combination with clothing and, more particularly, to identification snaps which are removably attachable to garments to serve as identification devices.

2. Prior Art

It is often desirable to mark garments with identifying indicia which indicates ownership of the garment. In other instances, it is desirable to mark pairs of garments, such as socks, with similar indicia so that they may easily be matched together after having been commingled with other like garments of similar size and color. This latter situation is especially troublesome for those who have impaired eyesight.

Traditionally, clothing has been marked to indicate ownership by sewing a label bearing identifying indicia to an inside surface of the garment which is hidden from view which worn. However, there are many disadvantages with such labels. These labels typically are sewn in and are time-consuming to install and remove. In addition, they do not provide an identifying means for those having impaired eyesight.

Therefore, it would be desirable to utilize a small identification device, with articles of clothing which would be easy to install and remove. It would also be desirable if such an identification device could carry identification indicia capable of perception by those having impaired eyesight.

There are many types of clamps or snap fasteners known in the art but none appear appropriate or even workable as an identifying device for clothing. For example, U.S. Pat. No. 3,729,780 is directed to a clamp having a pair of opposing disks carried at opposite ends of a foldable connecting strap. One of the disks carries a projecting, pointed shaft and the other disk carries a shaft receiving sleeve. The shaft has a pointed end which includes projections fitted about the periphery of the pointed end. The shaft includes a shoulder to retain the pointed end once it has penetrated into the sleeve. Such a device would be unsuitable for use with clothing in that the pointed end of the shaft would damage the woven fabric of the garment as the clamp is attached to the garment. In addition, the shaft receiving sleeve would tend to snag and damage fabric of another garment that may overlay the garment to which the clamp is attached.

Another type of clamp is disclosed in U.S. Pat. No. 4,044,412. This patent is directed to a tufting button which is used to compress a resilient fabric and consists of two conical members, one having a shaft with a pronged head, and the other having a shaft-receiving sleeve. A disadvantage of this type of clamp is that it cannot accommodate fabric of varying thicknesses. In addition, the clamp is designed to prevent separation of the two cone shaped members and it would therefore be difficult to remove the device for reuse on other garments.

A third type of fastener is disclosed in U.S. Pat. No. 2,709,290 which is directed to plastic closures for garments. The device consists of a plurality of hollow elements having heads with radial projections. The hollow elements are mounted on a plate member which includes a flange to be attached to a garment. The mating member consists of a complementary plate having a flange to be attached to another portion of the garment and includes a series of holes to receive the projecting elements mounted on the first plate member. The prongs are hollow and are deformable when inserted into the openings. This device is unsuitable for use as an identifying device for garments since the smallest clamp that could be formed having a hollow deformable prong would be too large and bulky to be carried on a garment that may be worn against the skin of the user.

In conclusion, none of the types of fasteners commonly known and used would be suitable for use as an identifying device for garments. Indeed, none of the previously mentioned patents discloses or suggests the use of a clamp or fastener as such an identifying device for clothing, nor do any of the clamps or fasteners carry identifying indicia.

Accordingly, there is a need for a device for identifying garments which is small so that it will not irritate the user of the device when wearing the garment to which it is attached; a device that is relatively easy and inexpensive to fabricate, thereby permitting mass production and the concomitant low price, and a device which can be repeatedly attached to and removed from garments of different fabric thicknesses. In addition, there is a need for an identification device that carries indicia which are capable of being discerned by persons having impaired eyesight.

SUMMARY OF THE INVENTION

The present invention provides an identification snap that is particularly designed to be used as an identification device for use with clothing. The identification snap of the present invention is small and can be made of inexpensive plastic materials such as polypropylene which permit mass production by well-known injection-molding techniques. In addition, this material permits the identification snap to be formed having a variety of shapes and colors, or raised letters or other indicia to provide distinguishing characteristics. The identification snap is designed so that it can be easily attached to or removed from a selected garment without damage to the woven fabric of the garment. The identification snap clamps the selected fabric by means of an interference fit between two clamping members which can accommodate fabric of varying thicknesses.

The identification snap of the present invention consists of a first plate member having substantially flat first inner and outer faces, a second plate member having substantially flat second inner and outer faces, a post projecting from the first inner face, and an orifice formed in the second plate member for receiving the post in an interference fit. At least one of the plate members carries identifying indicia which may be used to distinguish it from another identification snap. This identifying indicia may consist of a raised letter or number formed on the flat outer face of the plate member, or it may consist of the plate member having a discrete geometric shape. The identifying indicia preferably is associated with the first plate member since its outer face is uninterrupted by an orifice, as with the second plate member, and thus provides a larger background for the desired character. Alternatively, the first and second plate members can be formed of a plastic material having a color which is different from the colors of other identification snaps.

The identification snap is attached to a garment, such as a sock, by pressing the post of the first plate member through the woven fabric of the sock so that the terminal portion of the post extends from the other side of the fabric. The second plate member is placed so that the orifice registers with the post and the second plate is then pressed toward the first plate thereby causing the post to engage the orifice and be held therein by an interference fit. The identifying indicia is now attached to the garment and can serve to distinguish that particular garment from others or, when similar indicia are used in combination with matching garments, can serve to identify a selected pair of garments, such as gloves or socks.

There are many advantages inherent in the design of the identification snap of the present invention which make it particularly suitable for use in combination with garments. The post which extends from the first plate member preferably includes a relatively narrow shank which terminates in a bulbous tip. This bulbous tip permits the post to be inserted through the woven fabric of a garment without damaging the weave of the fabric. The orifice formed in the second plate member is defined by a frusto-conical wall which converges from the outer face to the inner face. The shape of this wall permits the orifice to receive the bulbous tip of the post to provide an interference fit at varying positions along the posterior portion of the bulbous tip. Thus, the first and second plates can be clamped together at varying distances and thereby permit the snap to accommodate woven fabrics of varying thicknesses.

The post which extends from the first plate member is solid and relatively incompressible; and the second plate member is formed so that the orifice deforms about the bulbous tip to receive the post. Thus, the identification snap can be made very small in size since the molding of a solid and relatively incompressible post can be accomplished with molds which are smaller than those required to form hollow flexible posts. In addition, the first and second plate members may be formed so that their outer faces include chamfered peripheries which slope downwardly toward their respective inner faces. This chamfered periphery reduces the likelihood that the identification snap will snag on other garments which may be worn over the garment to which the snap is attached.

There are a number of embodiments of the identification snap of the present invention which vary with respect to the identifying indicia associated with the first plate. One form of identification snap, for use by sighted persons, includes an identifying indicia which may consist of the snaps being formed of various colors. Another form may include a plate member having a raised letter, number, or monogram which would identify the ownership of the garment or aid in matching pairs of garments.

Alternatively, the identification snap may carry identifying indicia which would provide distinguishing features for users having imparied eyesight. In this form of the invention, the identifying indicia would consist of a plate member having a discrete geometric shape such as a diamond, triangle, circle, or hexagon. Thus, the user having impaired eyesight may discern the discrete shape of the first plate and thereby distinguish one garment from another. Alternatively, the outer face of a plate member could be formed to include Braille characters. Use of these forms of the invention would be particularly helpful in aiding users having imparied eyesight in selecting, for example, pairs of socks having the same color.

Accordingly, it is an object of the present invention to provide an identifying device for use with clothing made of woven material which is easily attached to and removed from the fabric of the clothing; that is designed to accommodate fabrics having a variety of thicknesses; that can be attached to woven fabric without damaging the weave of the fabric; that is designed so that it can be made small in size so that it will not irritate the user and that is easily fabricated from relatively inexpensive materials; and is designed so that it will not snag clothing which may overlay the clothing to which it is attached.

Other objects and advantages of the invention will be apparent from the following description, the accompanying drawings, and the appended claims.

DETAILED DESCRIPTION OF THE PREFERRED EMBODIMENT

Figure 1:
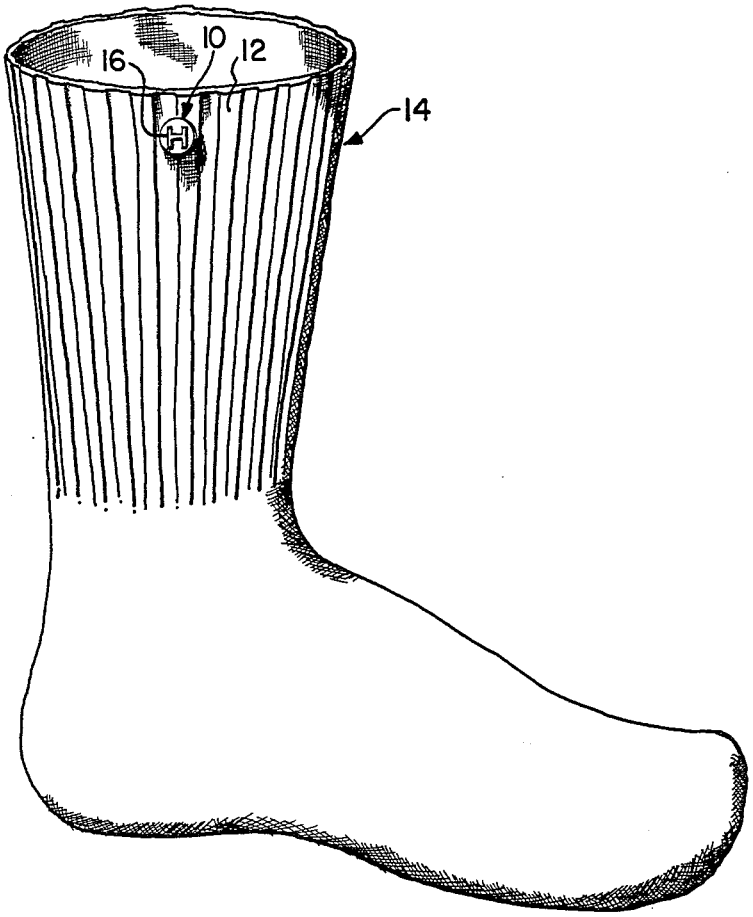
FIG. 1 is a view of the identification snap of the present invention attached to a sock.

As shown in FIG. 1, the identification snap of the present invention, generally designated 10, is mounted to the woven fabric 12 of a garment such as a sock 14. The snap 10 includes identifying indicia 16, such as the raised letter "H" shown here, which can be used to designate ownership of the sock 14 or aid in matching the sock with its mate.

Figure 2:
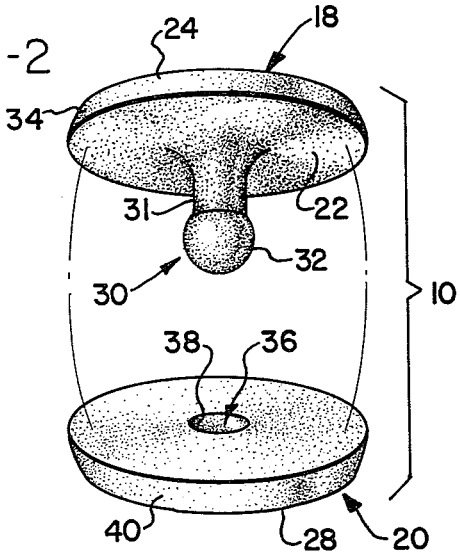
FIG. 2 is a perspective view of the snap in which the first and second plate members are separated to reveal the post and orifice.

As shown in FIG. 2, the snap 10 consists of a first plate member 18 and a second plate member 20. The first plate member 18 includes inner and outer faces 22, 24, respectively, and the second plate member 20 includes inner and outer faces 26, 28, respectively. The first plate member 18 includes a post 30 which is centrally located on and projects from the inner face 22. The post 30 includes a shank portion 31 and a bulbous tip 32 which is larger in diameter than the shank portion 31 and sized and shaped to permit penetration through and withdrawal from the woven fabric 12 without damage to the fabric. The outer face 24 of the first plate member 18 is bounded by a chamfered periphery 34 which is beveled outwardly toward the inner face 22. This chamfered periphery 34 reduces the likelihood that the first plate member 18 will snag on garments, such as a trouser leg for example, which may overlay the snap 10 when the sock 14 is worn.

The second plate member 20 includes a centrally located orifice 36 which extends from the inner face 26 to the outer face 28. The orifice 36 is sized to receive the post 30 and provide an interference fit with the bulbous tip 32. The orifice 36 is defined by a frusto-conical wall 38 which converges toward the inner face 26 of the second plate member. Like the first plate member 18, the outer face 28 of the second plate member 20 is bounded by a chamfered periphery 40 which is beveled outwardly from the outer face to the inner face 26.

Figure 3:
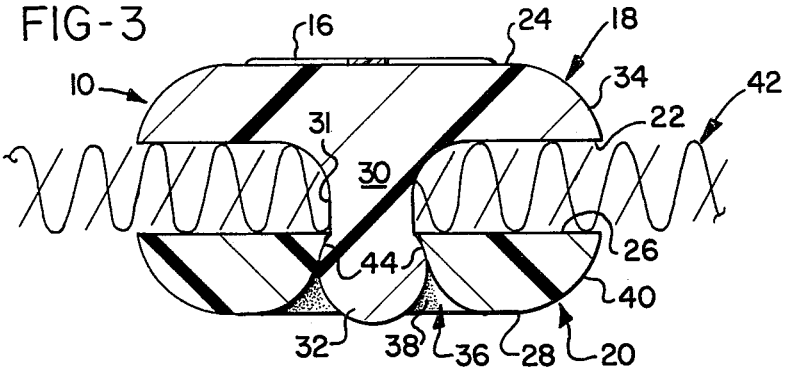
FIG. 3 is a cross-sectional view of the snap engaged to clamp a relatively thick fabric.
Figure 4:
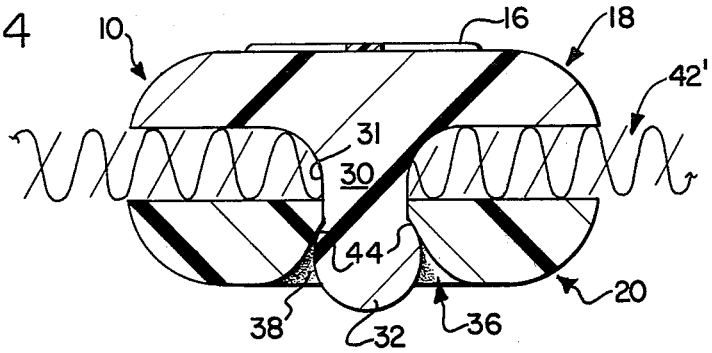
FIG. 4 is a cross-sectional view of the snap engaged to clamp a relatively thinner fabric.
Figure 5A:
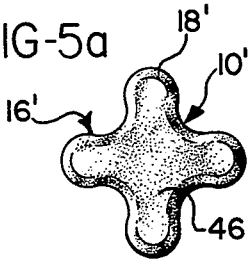
FIGS. 5*a*–5*f* show embodiments of the first plate member of the snap of the present invention in which a plurality of first plates are shown, each having a discrete geometric shape.
Figure 5B:
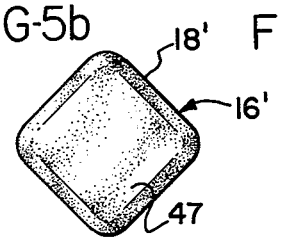
Figure 5C:
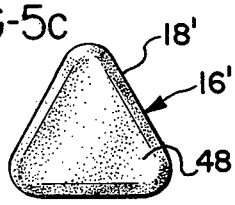
Figure 5D:
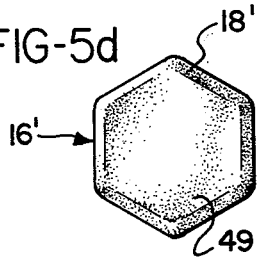
Figure 5E:
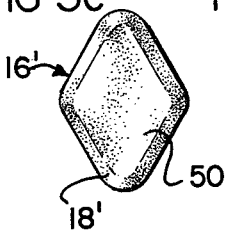
Figure 5F:
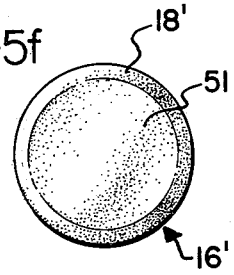

As shown in FIGS. 3 and 4, the first and second plate members 18, 20 of the snap 10 are joined together to clamp a woven fabric 42 by placing the first plate member adjacent the woven fabric so that the post 30 extends through the fabric, then pressing the second plate member to the fabric so that the post 30 enters the orifice 36 and the bulbous tip 32 engages the frusto-conical wall 38 in an interference fit. The length of the shank portion 31 and the inclination of the frusto-conical wall 38 permit the bulbous tip to contact the frusto-conical wall at a posterior portion 44. Since the frusto-conical wall 38 converges toward the inner face 26 of the second plate member 20, the engagement with the posterior portion 44 of the bulbous tip 32 tends to force the bulbous tip, and hence the first plate member 18, toward the second plate member.

This interaction of the bulbous tip 32 and frusto-conical wall 38 permits the snap 10 to be used in combination with woven fabrics having a variety of thicknesses. As shown in FIG. 4, the snap 10 is used to clamp woven fabric 42' which is thinner than that shown in FIG. 3. The post 30 and bulbous tip 32 extend into the orifice 36 to a greater extent with the thinner woven fabric 42' than with a thicker fabric 42 (FIG. 3). However, the bulbous tip 32 still engages the wall 38 at its posterior portion 44. As a result of the interference fit between the bulbous tip 32 and the wall 38, which has deformed about the tip, the wall 38 exerts a radially constrictive force upon the posterior portion 44 of the tip at varying locations along its length, so that the plate members 18, 20 are urged together to clamp fabrics of a variety of thicknesses.

As shown in FIGS. 3 and 4, the first and second plate members 18, 20 are preferably solid in construction and made of a flexible material such as polypropylene. The post 30 is solid and relatively incompressible so that the orifice 36, and hence the second plate member 20, must be deformed to permit the entrance of the bulbous tip 32 into the orifice. It is preferable to size the remainder of the shank portion 31 so that it does not engage the orifice 36 when the first and second plate members 18, 20 are clamped together since this would increase the force necessary to cause the plate members to engage or disengage.

In the embodiments shown in FIGS. 5*a–f*, the first plate member 18' of the snap 10' carries identifying indicia 16' which consists of discrete geometric shapes 46, 47, 48, 49, 50, 51. These embodiment of the snap 10' are most suitable for use by individuals having impaired eyesight. It is preferable to form the identifying indicia 16' in basic geometric shapes such as a cross 46, square 47, triangle 48, hexagon 49, diamond 50, or circle 51. These shapes of first plate members 18', when mounted on garments in the manner previously described, would enable an individual having impaired sight to discern his own garment from that of another or determine matching pairs of garments from a commingled assortment of garments of a similar kind. In addition, the snaps 10' shown in FIG. 5 can be attached to different articles of clothing so that snaps having common shapes are attached to articles which are coordinated to each other with respect to color and style. This would enable an individual having impaired sight to select garments to compose a coordinated outfit from among a plurality of garments of different colors or patterns.

The identification snap 10 of the present invention possesses many advantages over other devices used to identify clothing. The snap can be mass produced of inexpensive materials and is relatively small in size so that it is relatively inexpensive to purchase. In addition, the small size of the snap does not create a source of irritation to the wearer of the garment to which it is attached and does not distort the lines or lessen asthetic appeal of the garment to which it is attached. The snap is designed so that it can be easily attached to and removed from a selected woven fabric and is shaped so that the attachment to the fabric does not damage the fabric. The snap can be used indefinitely without deterioration of its ability to be attached to clothing. Since the snap can be fabricated from a variety of plastic materials, it can be designed so that it cannot be affected by the hot water and detergent normally used in washing machines so that it need not be removed from a garment prior to washing. The snap is also designed and shaped so that, when mounted, it will not snag clothing which may overlay the garment to which it is attached. And, finally, the snap is designed so that the first and second plate members engage to form an interference fit which can accommodate woven fabrics having a variety of thicknesses.

While the forms of apparatus herein described constitute preferred embodiments of this invention, it is to be understood that the invention is not limited to these precise forms of apparatus, and that changes may be made therein without departing from the scope of the invention.

What is claimed is:

1. An identification snap for attachment to woven material comprising:

a first plate member having first inner and outer faces;

post means projecting from said first inner face;

said post means including a shank portion and a bulbous tip of larger diameter than said shank portion;

a second plate member having second inner and outer faces;

said second plate member including a centrally disposed orifice extending from said second inner face to said second outer face for receiving said post means therein;

said orifice being defined by a substantially frusto-conical wall which extends from said second outer face to said second inner face and converges toward said second inner face;

said frusto-conical wall being shaped such that, when said first and second plate members are joined such that their respective inner faces oppose each other, said wall engages said bulbous tip only at a posterior portion thereof in an interference fit which tends to draw said first and second plate members toward each other such that posterior portion may engage said wall at varying locations between said second inner and outer faces thereby permitting woven materials of varying thicknesses to be clamped between said first and second plate members; and means associated with at least one of said plate members for distinguishing one of said snaps from another of said snaps.

2. The snap of claim 1 wherein said first and second outer faces have chamfered peripheries.

3. The snap of claim 1 wherein said post means is substantially incompressible and said second plate member is deformable to permit interengagement with said post means.

4. The snap of claim 1 wherein said means for distinguishing one of said snaps comprises a periphery of at least one of said first or second outer faces having a discrete geometric shape.

5. The snap of claim 1 wherein said means for distinguishing one of said snaps comprises raised indicia formed on at least one of said first or second outer faces.

6. The snap of claim 1 further comprising:

said first plate member having substantially flat first inner and outer faces, said first outer face having a chamfered periphery beveled outwardly to said first inner face;

said post means being substantially incompressible; and said second plate member having substantially flat second inner and outer faces, said second outer face having a chamfered periphery beveled outwardly to said second inner face.

7. An identification snap for attachment to woven material comprising:

a first plate member having substantially flat first inner and outer faces, said first outer face having a chamfered periphery beveled outwardly to said first inner face;

substantially incompressible post means projecting from said first inner face;

said post means including a shank portion and a bulbous tip of larger diameter than said shank portion;

a second plate member having substantially flat second inner and outer faces, said second outer face having a chamfered periphery beveled outwardly to said first inner face;

said second plate member including a centrally disposed orifice extending from said second inner face to said second outer face for receiving said post means therein;

said orifice being defined by a substantially frusto-conical wall which extends from said second outer face to said second inner face and converges toward said second inner face;

said frusto-conical wall being shaped such that, when said first and second plate members are joined such that their respective inner faces oppose each other, said wall engages said bulbous tip only at a posterior portion thereof in an interference fit which tends to draw said first and second plate members toward each other such that said posterior portion may engage said wall at varying locations between said second inner and outer faces thereby permitting woven materials of varying thicknesses to be clamped between said first and second plate members;

said second plate member being deformable to permit interengagement with said post means; and means associated with at least one of said plate members for distinguishing one of said snaps from another of said snaps.

8. The snap of claim 7 wherein said means for distinguishing one of said snaps comprises raised indicia formed on said first outer face.

9. The snap of claim 7 wherein said means for distinguishing one of said snaps comprises said first outer face having a discrete geometric shape.

* * * * *